US009392837B1

(12) United States Patent
Murphy

(10) Patent No.: US 9,392,837 B1
(45) Date of Patent: Jul. 19, 2016

(54) INTERCHANGEABLE SHOE HEELS

(71) Applicant: Michael E. Murphy, Lower Sackville (CA)

(72) Inventor: Michael E. Murphy, Lower Sackville (CA)

( * ) Notice: Subject to any disclaimer, the term of this patent is extended or adjusted under 35 U.S.C. 154(b) by 233 days.

(21) Appl. No.: 13/855,978

(22) Filed: Apr. 3, 2013

(51) Int. Cl.
*A43B 3/24* (2006.01)
*A43B 13/36* (2006.01)

(52) U.S. Cl.
CPC ..... *A43B 3/246* (2013.01); *A43B 3/244* (2013.01); *A43B 13/36* (2013.01)

(58) Field of Classification Search
CPC ..... A43B 13/36; A43B 21/42; A43B 3/24; A43B 3/242; A43B 3/244; A43B 3/246
USPC ..... 36/15, 100, 101, 42
See application file for complete search history.

(56) References Cited

U.S. PATENT DOCUMENTS

| | | | | |
|---|---|---|---|---|
| 2,076,514 | A | 4/1937 | Huffman | |
| 2,751,691 | A * | 6/1956 | Clark, Jr. | 36/1 |
| 2,761,224 | A * | 9/1956 | Gardiner | 36/11.5 |
| 2,873,540 | A * | 2/1959 | Murphy | 36/101 |
| 3,012,340 | A | 12/1961 | Reinhart | |
| 3,204,346 | A * | 9/1965 | Lockard et al. | 36/101 |
| 3,270,442 | A | 9/1966 | Liebmann et al. | |
| 3,608,213 | A | 9/1971 | Jensen | |
| 4,267,649 | A | 5/1981 | Smith | |
| 4,363,177 | A * | 12/1982 | Boros | 36/101 |
| 4,995,174 | A | 2/1991 | Hong et al. | |
| 5,311,676 | A | 5/1994 | Hughes et al. | |
| 7,698,834 | B1 * | 4/2010 | Courville | 36/15 |
| 8,015,731 | B2 | 9/2011 | Jackson | |
| 2005/0016019 | A1 * | 1/2005 | Smith et al. | 36/11.5 |
| 2005/0126045 | A1 * | 6/2005 | Guidry | 36/101 |
| 2007/0130802 | A1 * | 6/2007 | Condie | 36/101 |
| 2009/0229145 | A1 * | 9/2009 | Ortner | 36/100 |
| 2011/0067265 | A1 * | 3/2011 | Green | 36/42 |

* cited by examiner

*Primary Examiner* — Marie Bays
(74) *Attorney, Agent, or Firm* — Robert C. Montgomery; Montgomery Patent & Design LP

(57) ABSTRACT

A shoe system incorporates an open toe design having a receptacle in a heel that receives various heel designs and a toe spring for attaching various toes to give the shoe different appearances. The attachable toe configures the shoe to a closed-toe style.

13 Claims, 4 Drawing Sheets

INTERCHANGEABLE SHOE HEELS

RELATED APPLICATIONS

There are no current co-pending applications.

FIELD OF THE INVENTION

The presently disclosed subject matter is directed to shoes. More particularly, the present invention relates to customizable shoes having interchangeable features.

BACKGROUND OF THE INVENTION

Modern fashion dictates an ever-evolving and changing set of shoes, clothing, hats, and accessories. What is cutting edge popular today may well be considered unacceptably passé tomorrow. When attempting to be at the forefront of the fashion industry one must be in constant search for new and innovative styles. However, the rewards for identifying and defining the next big fashion trend can be great.

Footwear in particular is susceptible to rapidly changing fashion treads. A slightly different heel or toe can make one shoe highly distinctive and far more desirable than another. Additionally, a shoe that is very acceptable in one (1) situation might be unacceptable in another. For example, the particular flashiness of one (1) shoe may be unacceptable at work but very desirable at a party. A skinny, "stiletto-style" metal heel may not be suitable for casual use but a flat heel could be. Unfortunately, the cost of having multiple styles of shoes can be prohibitive.

In view of the foregoing, shoes having interchangeable features would be beneficial. In particular, a shoe system having interchangeable toes and/or heels would be desirable.

SUMMARY OF THE INVENTION

The principles of the present invention provide for a shoe system having interchangeable heels and toes. Such a system incorporates an open toe design and a heel receptacle. The open toe and heel receptacle are configured to receive various toe and heels that enable the shoe system to have different appearances. Different attachable toes can configure the shoe with a multitude of closed-toe styles while different heels can provide dramatically different looks. All this can be accomplished at low cost and with minimal effort.

A shoe assembly that is in accord with the present invention includes an upper heel having a threaded insert, a mid-sole that extends from the upper heel, a toe spring that extends from the mid-sole; and a first heel having a first threaded stud which is threaded into the threaded insert. The shoe assembly further includes a second heel having a second threaded stud that is configured to thread into the upper heal such that the second heel is interchangeable with the first heel. The shoe assembly may include a heel cup behind the upper heel and a strap, vamp or other means for attaching the shoe assembly to a user. Beneficially the shoe assembly includes a high-friction bottom while the first heel includes a mating surface subjacent the first threaded stud such that the mating surface provides a stop that enables tightening the first heel against the upper heel. The shoe assembly may also include a first toe having an interconnecting plate and a toe slot. The toe spring then includes a lip which forms a spring slot, and the interconnecting plate fits into the spring slot.

Another shoe assembly that is in accord with the present invention includes an upper heel, a mid-sole that extends from the upper heel, and a toe spring that extends from the mid-sole. The toe spring includes an upper lip that defines a spring slot. The shoe assembly further includes a first toe having a first flat plate that is disposed around its perimeter to define a first toe slot. The first flat plate inserts into the spring slot to attach the first toe to the toe spring. The shoe assembly further includes a second toe having a second flat plate that is disposed around its perimeter to define a second toe slot. The second toe is interchangeable with the first toe. Beneficially the shoe assembly also includes a heel cup behind the upper heel and a strap, vamp, or other means for attaching the shoe assembly to a user.

Yet another shoe assembly that is in accord with the present invention includes an upper heel having a receiver, a mid-sole that extends from the upper heel, and a toe spring that extends from the mid-sole. The toe spring includes an upper lip that defines a spring slot. A first heel is attached to the receiver and a first toe having a first flat plate disposed around its perimeter to define a first toe slot is attached to the toe spring In practice the receiver includes a threaded insert while the first heel includes a first stud that is threaded into the threaded insert. The shoe assembly can further include second heel having a second stud configured to thread into the threaded insert such that the second heel is interchangeable with the first heel. There may be a heel cup behind the upper heel, the first heel may include both a high-friction bottom and a mating surface subjacent the first stud to provide a stop that enables tightening the first heel against the upper heel. In addition there may be a second toe having an interconnecting plate and a toe slot that is interchangeable with the first toe.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
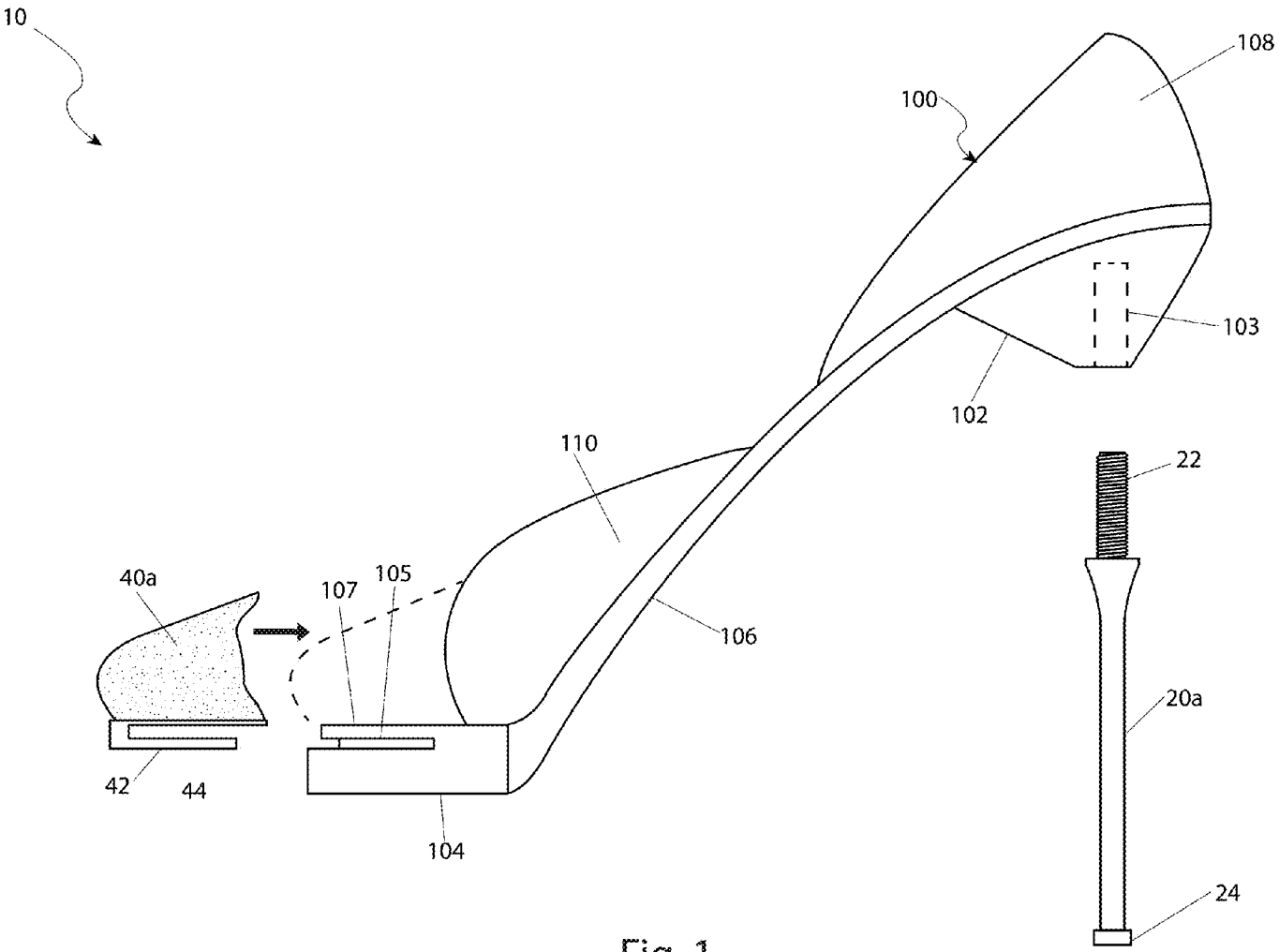
FIG. 1 is an exploded view of a shoe 10 having interchangeable features that is in accord with the preferred embodiment of the present invention.

10 shoe with interchangeable features
20*a* first heel
20*b* second heel
20*c* third heel
20*d* fourth heel
22 threaded stud

23 mating surface
24 tip
40*a* first toe
40*b* second toe
40*c* third toe
40*d* fourth toe
42 plate
46 finish
100 shoe assembly
102 upper heel
103 threaded insert
104 toe spring
105 slot
106 mid-sole
107 lip
108 heel cup
110 vamp

DETAILED DESCRIPTION OF THE PREFERRED EMBODIMENT

The best mode for carrying out the invention is presented in terms of its preferred embodiment, herein depicted within FIGS. 1 through 3*e*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

FIG. 1 presents an exploded view of a shoe 10 having a shoe assembly 100 which supports a number of interchangeable features. The shoe 10 is shown as an open-toed, high heeled shoe. However, that is simply for purposes of illustration and not limitation. In particular, the shoe assembly 100 supports interchangeable heels (shown in FIG. 1 with a first heal 20*a*) and toes (shown in FIG. 1 with a first toe 40*a*). Those interchangeable sections enable multiple shoe assembly 100 configurations which provide multiple appearance configurations.

The shoe assembly 100 includes many of the expected conventional shoe sections including an upper heel 102, a toe spring 104, a mid-sole 106, a heel cup 108, and a vamp 110 (or some way to secure the shoe 10 to a user's foot). The shoe assembly 100 further supports the first heel 20*a*, which is beneficially threaded into the upper heel 102.

Figure 2A:
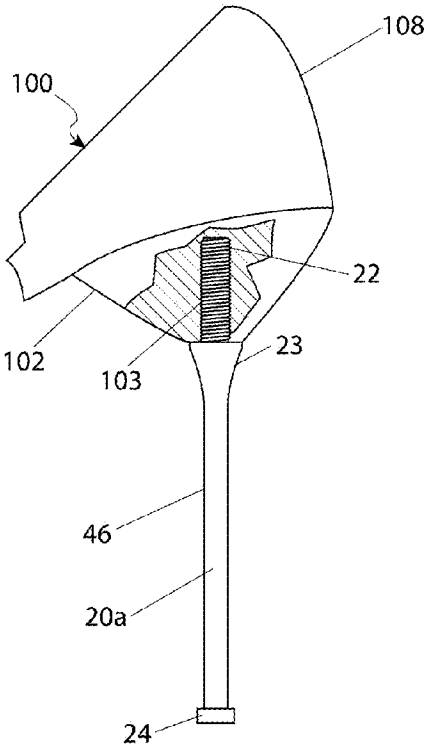
FIG. 2*a* is a close-up view of an upper heel 102 and a first heel 20*a* of the shoe 10 shown in FIG. 1.
Figure 2B:
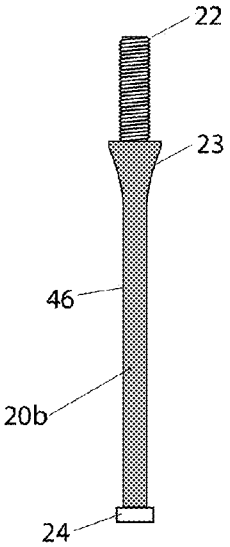
FIG. 2*b* is a close-up view of a second heel 20*b* suitable for use in the upper heel 102 of the shoe 10 shown in FIG. 1.
Figure 2C:
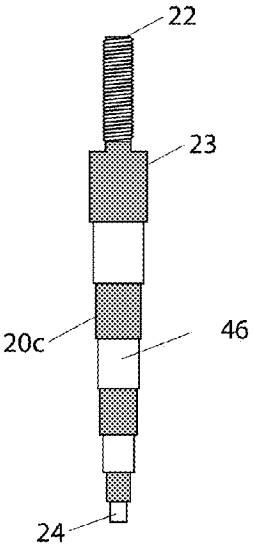
FIG. 2*c* is a close-up view of a third heel 20*c* suitable for use in the upper heel 102 of the shoe 10 shown in FIG. 1.
Figure 2D:
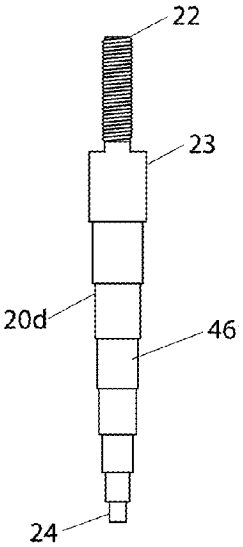
FIG. 2*d* is a close-up view of a fourth heel 20*d* suitable for use in the upper heel 102 of the shoe 10 shown in FIG. 1.
Figure 3A:
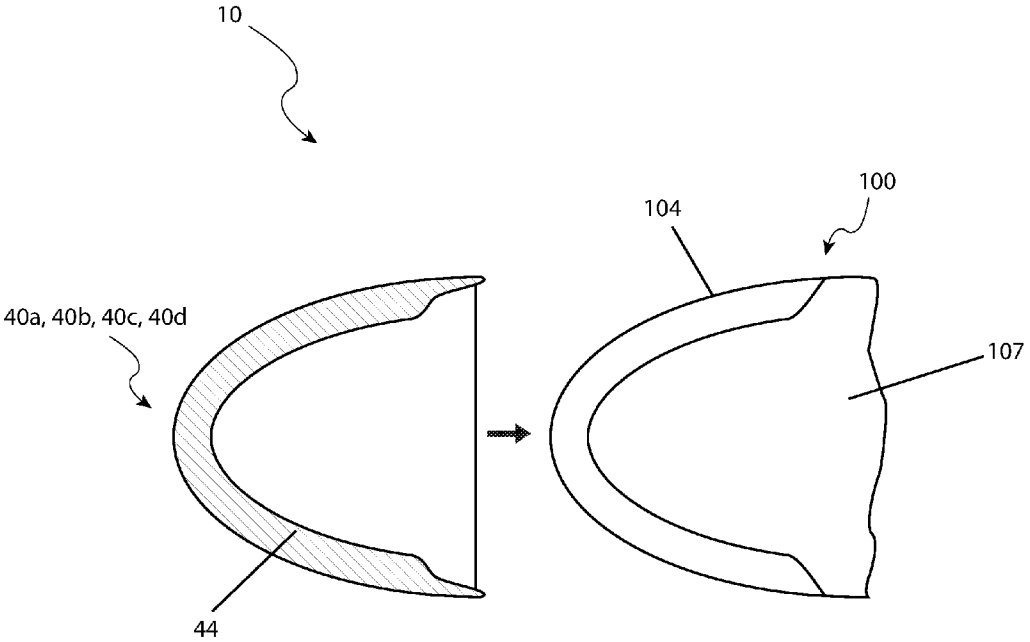
FIG. 3*a* is a top view of a first toe insert 40*a* for a shoe assembly 100 of the shoe 10 shown in FIG. 1.
Figure 3B:
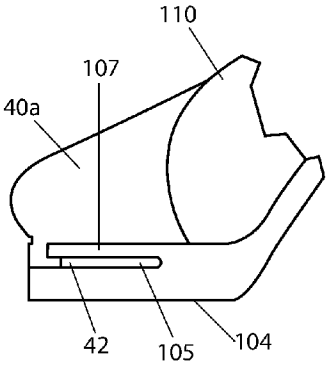
FIG. 3*b* is a side close-up view of the first toe insert 40*a* shown in FIG. 3*a;*
Figure 3C:
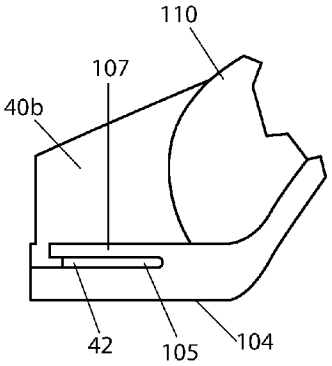
FIG. 3*c* is a side close-up view of a second toe insert 40*b* for the shoe assembly 100 of the shoe 10 shown in FIG. 1.
Figure 3D:
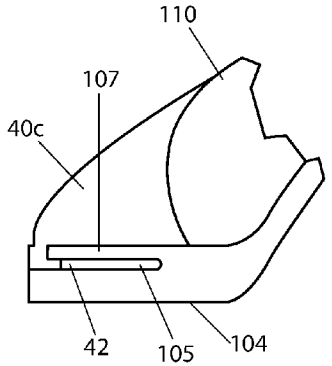
FIG. 3*d* is a side close-up view of a third toe insert 40*c* for the shoe assembly 100 of the shoe 10 shown in FIG. 1; and, FIG. 3*e* is a side close-up view of a fourth toe insert 40*d* for the shoe assembly 100 of the shoe 10 shown in FIG. 1.
Figure 3E:
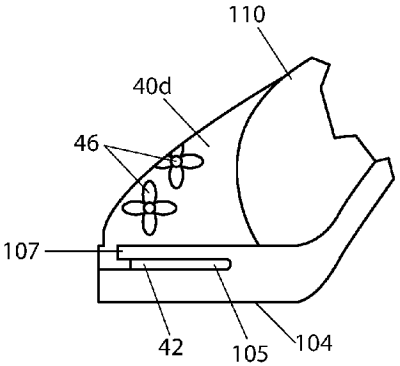

Referring now to FIGS. 2*b*-2*d* the first heel 20*a* may be interchanged with other heels 20*b*, 20*c*, 20*d*, which for convenience are shown as being the same height. The interchange is described in more detail below. Referring now to FIGS. 1 and 3*a*, the first toe 40*a* includes an interconnecting plate 42 having a toe slot 44. The interconnecting plate 42 and toe slot 44 enable the first toe 40*a* to removably mate with the shoe assembly 100 in a manner that is described in more detail below. The configuration of the first toe 40*a* enables interchanging it with other toes 40*b*, 40*c*, and 40*d* that also have interconnecting plates 42 and slots 44, see FIGS. 3*a*, 3*b*, 3*c*, and 3*d*.

Referring now to FIGS. 2*a* through 2*d*, respectively close-up views of the upper heel 102 and various heels specifically including the first heel 20*a*, a second heel 20*b*, a third heel 20*c* and a fourth heel 20*d*. The upper heel 102 includes a female threaded insert 103. The insert 103 enables threaded mating with a threaded stud 22 located at the top of each heel 20*a*, 20*b*, 20*c*, 20*d*. The threaded insert 103 and threaded studs 22 enable a user to interchange heels.

The various heels 20*a*, 20*b*, 20*c*, 20*d* are envisioned as being made from sturdy materials such as, but not limited to: metal, plastic, wood, or the like. In addition, the illustrated threaded stud 22 and the female threaded insert 103 provide a strong, easily made connection. However, other methods of attachment such as a friction fit, an interference-fit, or the like, may be utilized with similar benefit.

The heels 20*a*, 20*b*, 20*c*, 20*d* are envisioned as being purchased singularly or as a set along with a desired shoe assembly 100. The heels 20*a*, 20*b*, 20*c*, 20*d* may take different designs and shapes such as, but not limited to: a stiletto-style heel, a cone heel, a prism heel, and the like. The heels 20*a*, 20*b*, 20*c*, 20*d* are envisioned as being introduced in various colors and finishes 46. Beneficially the heels 20*a*, 20*b*, 20*c*, 20*d* have integral high-friction bottom tips 24 made from rubber, leather, or another anti-skid material.

The heels 20*a*, 20*b*, 20*c*, 20*d* preferably include an integrally-formed mating surface 23 that is located subjacent to the threaded stud 22. During installation, as the threaded stud 22 is threaded into the insert 103 the mating surface 23 acts as a stop that enables tightening a heel 20*a*, 20*b*, 20*c*, 20*d* against the bottom of the upper heel 102 using a common hand tool such as a wrench. This firmly attaches a heel to the upper heel 102.

Although the shoe assembly 100 is illustrated as a high-heel shoe, it is envisioned that the teachings of the invention may be incorporated into various formal or dress shoe styles made using different designs, materials, and colors, and as such the foregoing descriptions of a high-heel shoe should not be interpreted as a limiting factor of the system 10.

Refer now to FIGS. 3*a*, 3*b*, 3*c*, 3*d*, 3*e*, respectively top and side views of toes 40*a*, 40*b*, 40*c*, 40*d* of the system 10, and to FIG. 1. The shoe assembly 100 includes a generally horizontal toe spring 104. Disposed around the perimeter of the toe spring 104 and slightly above and parallel with the toe spring 104 is a lip 107. The space between the top of the toe spring 104 is the bottom of the lip 107 defines a spring slot 105. Each toe 40*a*, 40*b*, 40*c*, 40*d* includes an integral flat plate 42 that is disposed around and below the perimeter of the toe 40*a*, 40*b*, 40*c*, 40*d* so as to form the toe slot 44.

The flat plate 42 is suitably sized so as to insert into the spring slot 105. Each toe 40*a*, 40*b*, 40*c*, 40*d* includes a flat plate 42 for insertion into the spring slot 105 of the shoe assembly 100 to enable interchangeable toes 40*a*, 40*b*, 40*c*, 40*d* to enable changing the appearance of the shoe assembly 100. The toe plate 42 and the spring slot 105 provide a relative interference fit to retain the toe plate 42 within the spring slot 105 until such time as the user desires to reconfigure the shoe assembly 100 using another toe 40*a*, 40*b*, 40*c*, 40*d*.

The toes 40*a*, 40*b*, 40*c*, 40*d*, are envisioned as providing a variety of toe shapes and designs such as, but not limited to: a plain round toe 40*a*, round toe with print 40*d*, a square toe 40*b*, a pointed toe 40*c*, and the like, which are introduced in various colors and decorative finishes 46.

It is envisioned that other styles and configurations of the present invention can be incorporated into the teachings of the present invention. While only one particular configuration is shown and described that is for purposes of clarity and disclosure and not by way of limitation of scope.

The preferred embodiment of the present invention can be utilized by the common user in a simple and effortless manner with little or no training. After initial purchase or acquisition of the system 10 it would be configured as indicated in FIGS. 1 through 3*e*.

The method of installing and using the system 10 may be achieved by: procuring the system 10 along with at least one (1) heel 20*a*, 20*b*, 20*c*, 20*d* and one (1) toe 40*a*, 40*b*, 40*c*, 40*d* for each shoe assembly 100 based upon a user's preference; selecting and installing a heel 20*a*, 20*b*, 20*c*, 20*d* onto each shoe assembly 100 by threading the stud 22 of the heel 20*a*, 20*b*, 20*c*, 20*d* into the insert 103 of the upper heel 102; tightening the threaded stud 22 using a hand tool such as a wrench; installing a toe 40*a*, 40*b*, 40*c*, 40*d* onto the toe spring 104 by inserting a respective plate 42 of the toe 40*a*, 40*b*, 40*c*, 40*d* into the spring slot 105 of the toe spring 104 until obtaining a fully engaged and secure friction fit; wearing the specifically configured shoe assembly 100 in a normal manner as desired; and, benefiting from an easily reconfigured footwear system 10 afforded a user of the system 10.

The method of reconfiguring and changing the appearance of the system 10 may be achieved by performing the following steps: removing the previously installed heel 20*a*, 20*b*, 20*c*, 20*d* using a tool; reinstalling a different desired heel 20*a*, 20*b*, 20*c*, 20*d* as described above; removing the previously installed toe 40*a*, 40*b*, 40*c*, 40*d*; and reinstalling a different desired toe 40*a*, 40*b*, 40*c*, 40*d* as described above.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A shoe assembly, comprising:

an upper heel;

a mid-sole extending from said upper heel;

a toe spring extending from said mid-sole and having a bottom section with an outer perimeter and an upper lip extending over part of said bottom section and separated from said bottom section by a spring slot, wherein said upper lip does not extend to said toe spring outer perimeter; and, a first toe having a first toe upper section with a first toe outer perimeter equal to said toe spring outer perimeter and a first flat plate under said first toe upper section and separated from said first toe upper section by a first toe slot, wherein said first flat plate does not extend to said first toe outer perimeter;

wherein said first flat plate inserts into said spring slot to attach said first toe to said toe spring.

2. The shoe assembly according to claim 1, further including a second toe having a second toe upper section with a second toe outer perimeter equal to said toe spring outer perimeter and a second flat plate under said second toe upper section and separated from said second toe upper section by a second toe slot, wherein said second flat plate does not extend to said second toe outer perimeter, wherein said second toe is interchangeable with said first toe.

3. The shoe assembly according to claim 2, further comprising a heel cup behind said upper heel.

4. The shoe assembly according to claim 2, further including a strap for attaching said shoe assembly to a user.

5. A shoe assembly, comprising:

an upper heel having a receiver;

a mid-sole extending from said upper heel;

a first heel attached to said receiver;

a toe spring extending from said mid-sole and having a bottom section with an outer perimeter and an upper lip extending over part of said bottom section and separated from said bottom section by a spring slot, wherein said upper lip does not extend to said toe spring outer perimeter; and, a first toe having a first toe upper section with a first toe outer perimeter equal to said toe spring outer perimeter and a first flat plate under said first toe upper section and separated from said first toe upper section by a first toe slot, wherein said first flat plate does not extend to said first toe outer perimeter;

wherein said first flat plate inserts into said spring slot to attach said first toe to said toe spring.

6. The shoe assembly according to claim 5, wherein said receiver includes a threaded insert.

7. The shoe assembly according to claim 6, wherein said first heel includes a first stud threaded into said threaded insert.

8. The shoe assembly according to claim 7, further including a second heel having a second stud configured to thread into said threaded insert, wherein said second heel is interchangeable with said first heel.

9. The shoe assembly according to claim 8, further comprising a heel cup behind said upper heel.

10. The shoe assembly according to claim 8, wherein said first heel further includes a high-friction bottom.

11. The shoe assembly according to claim 8, wherein said first heel further includes a mating surface subjacent said first stud, said mating surface providing a stop that enables tightening said first heel against said upper heel.

12. The shoe assembly according to claim 5, further including a second toe having a second toe upper section with a second toe outer perimeter equal to said toe spring outer perimeter and a second flat plate under said second toe upper section and separated from said second toe upper section by a second toe slot, wherein said second flat plate does not extend to said second toe outer perimeter, wherein said second toe is interchangeable with said first toe.

13. The shoe assembly according to claim 5, further including a strap for attaching said shoe assembly to a user.

* * * * *